US008316790B2

(12) United States Patent
Coon

(10) Patent No.: US 8,316,790 B2
(45) Date of Patent: Nov. 27, 2012

(54) MEDICAL TASK STATUS CHECKLIST AND MANUFACTURING METHOD THEREFORE

(76) Inventor: Darren Coon, Brockport, NY (US)

( * ) Notice: Subject to any disclaimer, the term of this patent is extended or adjusted under 35 U.S.C. 154(b) by 402 days.

(21) Appl. No.: 12/794,760

(22) Filed: Jun. 6, 2010

(65) Prior Publication Data

US 2011/0297075 A1 Dec. 8, 2011

(51) Int. Cl.
*G09F 9/00* (2006.01)
*G09F 7/10* (2006.01)

(52) U.S. Cl. ..... 116/324; 116/321

(58) Field of Classification Search ..... 116/321, 116/322, 323, 324, 307, 308; 40/5, 488, 40/490, 491; 235/123; D10/46.1
See application file for complete search history.

(56) References Cited

U.S. PATENT DOCUMENTS

| | | | | | |
|---|---|---|---|---|---|
| 1,434,073 | A | * | 10/1922 | Turner | 40/488 |
| 1,468,901 | A | * | 9/1923 | Eveson | 235/123 |
| 1,659,691 | A | | 5/1927 | Kingman | |
| 1,683,358 | A | | 9/1928 | Kingman | |
| 1,772,703 | A | * | 8/1930 | Burleigh | 116/225 |
| 2,288,728 | A | | 3/1939 | Meredith | |
| 2,461,811 | A | * | 2/1949 | Cusano | 235/123 |
| 2,527,621 | A | * | 10/1950 | Decepoli | 235/123 |
| 2,731,941 | A | | 1/1956 | Anderson | |
| 3,292,284 | A | | 12/1966 | Manzo | |
| 3,292,851 | A | * | 12/1966 | Tippin et al. | 235/61 E |
| 3,343,290 | A | | 9/1967 | Madansky | |
| 3,397,434 | A | * | 8/1968 | Arblaster | 40/5 |
| 3,485,204 | A | | 12/1969 | Christman | |
| 3,564,731 | A | | 2/1971 | Weller | |
| 3,913,249 | A | | 10/1975 | Kaslow | |
| 3,916,547 | A | | 11/1975 | Ryder | |
| 3,962,808 | A | | 6/1976 | Ryder | |
| 4,041,893 | A | * | 8/1977 | Mulloy | 116/308 |
| 4,189,143 | A | | 2/1980 | Van Auken et al. | |
| 4,520,749 | A | | 6/1985 | Jefferson | |
| 4,582,018 | A | | 4/1986 | Fleck et al. | |
| 4,703,712 | A | | 11/1987 | Christman | |
| 4,885,857 | A | | 12/1989 | Leflet | |
| 5,016,147 | A | | 5/1991 | Voorhees | |
| 5,253,441 | A | | 10/1993 | Rachiele | |
| D386,529 | S | | 11/1997 | Karvinen | |
| 7,000,920 | B2 | | 2/2006 | Camp | |
| 7,257,873 | B2 | * | 8/2007 | Laivins et al. | 29/412 |
| 7,467,449 | B1 | * | 12/2008 | Lee et al. | 29/26 A |
| 7,614,358 | B2 | * | 11/2009 | Duer | 116/324 |
| 7,665,200 | B1 | * | 2/2010 | Shimooka | 29/560 |
| 2008/0168940 | A1 | * | 7/2008 | Duer et al. | 116/324 |

* cited by examiner

*Primary Examiner* — R. A. Smith
(74) *Attorney, Agent, or Firm* — Tracy Jong Law Firm; Tracy P. Jong; Cheng Ning Jong

(57) ABSTRACT

A durable medical task status indicator comprises a panel having a front face and a rear face, at least an indicium disposed on one or more lines on the panel, at least one two-status indicator disposed to the left or right of the at least one indicium which corresponds to the indicator, the indicator comprises a first elongated slot formed in the front face of the panel, a second elongated slot formed in the rear face of the panel, two status labels, an elongated tab having a centrally disposed finger hold, an elongated backing plate is configured to slide within the second elongated slot, wherein the elongated backing plate is fixedly attached to the elongated tab such that the movement of the elongated backing plate is coordinated with the movement of the elongated tab and the elongated tab substantially covers the first elongated slot to avoid dirt collection and facilitate cleaning.

13 Claims, 15 Drawing Sheets

MEDICAL TASK STATUS CHECKLIST AND MANUFACTURING METHOD THEREFORE

BACKGROUND OF THE INVENTION

1. The Field of the Invention The present invention is directed generally to physical task status indicators and checklists, and more particularly, to a checklist comprising slider type task status indicators used in generally sanitary environments such as hospitals, surgical rooms, patient care facilities, and the like.

2. Background Art

Briefly, there are many devices known in the art for indicating the status of a task. Typically, they are used to indicate whether it has been completed or remains pending. Prior art checklists comprise a panel on which indicators are positioned alongside wording corresponding to the indicators. Most indicators have elongated slots along which tabs are manually slid when the status has changed. As such, dust, soil or other debris tends to collect within the open slots. The sliding movement of the tabs further causes debris to be permanently etched into contact surfaces between the tabs and the slots making the indicators even more difficult to clean. As such, these devices do not adequately meet the needs of the medical community working in sterile environments. It is imperative in a clean environment, such as that of a hospital or an operating room, that a task status indicator be clean, easy to clean and easily maintained.

In use, a task status indicator is used to indicate whether a task has been completed. There are typically two possible states (e.g., done or not done) from which a state is chosen to indicate the status of a task. A physical task status indicator, such as one proposed by the Applicant herein, is often used as a redundant but rapid source of indication of a series of procedures being carried out over a period of time. In addition to indicating status physically on a board, record is typically kept electronically or on paper as a backup measure or for other medical or safety audit purposes. A physical status indicator is a rapid way to communicate status without requiring steps associated with checking a paper or electronic record.

A prior art medical status checklist commonly used in hospitals comprises a board on which indicators are affixed. Due to material and installation costs, most boards are made of commonly available polymeric materials such as plastic. The means by which the indicators are affixed are not robust and therefore can cause indicators to deteriorate, become brittle and fail only after very limited number of indicator actuations. Such indicators are typically glued, taped or solvent bonded onto a board. As a board bends due to improper mounting on a wall, such attachment of indicators tends to cause indicators to detach and eventually fall off from the board surface. Since boards are typically constructed from thin plastic, when indicators are secured to boards by screws, there tends to be cracking at the attachment points of the indicators to the board due to the brittle nature of the thin board.

U.S. Pat. No. 3,343,294 discloses a device used in aiding an aircraft pilot in take-off and landing procedures. This device comprises a plurality of slots and tabs, each tab disposed within a slot and configured to be slideable along the slot, leaving space within the slot to collect debris. Although such a slide can function as an indicator, the ease with which the slots collect debris and the difficulty in removing debris collected in the slots make this type of task status indicator unsuitable to meet the requirements of a clean environment. In a hospital or operating room setting, personnel using such a task status indicator often have soiled hands introducing the risk of contagion or transfer of infectious diseases by contact. After each series of tasks has been completed or each shift, task status indicators are often sanitized by being sprayed with anti-microbial solutions and wiped down. Cleaning task status indicators having slots would be time-consuming and impractical since the debris would have entered the surfaces which provide sliding relationship between the tabs and the slots. Cleaning solution may also enter the interface between the insert member and the mounting panel secured with tongue and groove relationship if the transverse webs are narrow. The prior art device is constructed from multiple layers of materials, i.e., the top cover, cover plate and mounting panel, making it economically unfeasible for many applications.

U.S. Pat. No. 4,703,712 discloses yet another slider type mechanism for indicating one of a plurality of selective positions. The slider type mechanism comprises a frame with an elongated slot along which a slide is configured to be slideable and a base plate on which distinctively colored areas are disposed. Each slider type mechanism is secured via a double adhesive strip to a surface. This is an example of a temporary indicator since each slider mechanism is not integrally formed or securely affixed to a panel to withstand repeated use due to a poor bond between a slider mechanism and flexing of the double adhesive strip when stressed. This prior art device also comprises an exposed elongated slot on which debris can easily collect and not conducive to rapid wipe down.

In addition, there have been attempts to produce task checklists which use an elongated frame area which groups all pre-made indicators on one column of a panel together. Adjacent this frame to the left or right are indicia, such as lettering, which are designed to correspond to the indicators. However, in many cases, an indicium encompasses multiple lines of lettering or indicators. In such cases, excess indicators will be blocked or disabled, leaving only a first indicator to correspond to the indicium to indicate the status of the task. Such a checklist fails to correlate clearly indicia with their corresponding indicators which in turn can lead to misinterpretation of the task statuses.

Today, dry erase boards have been adopted in many applications including its use as task status indicators. Such use in the medical industry may be fraught with errors since the marks left on a dry erase board are easily erasable. In use, tasks are simply written on the board or written on labels which are then adhered to a dry erase board and an area adjacent each of the tasks is provided such that a status indication can be written with a dry erase marker. Statusing a task related to a medical procedure or routine this way does not convey the seriousness of a task nor does it guard against accidental or intentional erasure.

In view of the foregoing drawbacks, there exists a need for a durable, simple, economical physical status checklist that can be used to clearly indicate and communicate the status of a series of procedures that is hygienic and can be easily cleaned and that can withstand repeated use without fail.

SUMMARY OF THE INVENTION

In accordance with the present invention, there is provided a physical medical task status checklist that is durable and capable of withstanding repeated use without fail. The present medical status checklist comprises a panel having at least one task as indicated by an indicium disposed on one or more lines on the front face of the panel. The indicium's size is delineated its extremities. There is also one or more two-status indicators disposed to the left or right of the indicia such that the horizontal central axis of the indicium is substantially coaxial with the horizontal central axis of the two-status indicator.

The indicator is an elongated slot formed in the front face of the panel and longitudinally aligned with the horizontal central axis of the indicator. There is a second elongated slot formed in the rear face of the panel and centrally disposed along the length and width of the first elongated slot. The width of the first elongated slot is slightly smaller than the width of the second elongated slot and the length of the first elongated slot is substantially smaller than the length of the second elongated slot such that a ledge is formed around the periphery of the second elongated slot.

The indicator further comprises two status labels, each disposed adjacent each lengthwise end of the first elongated slot, an elongated tab having a centrally disposed raised ridge and positioned on the front face of the panel, and an elongated backing plate. The elongated backing plate is configured to slide within the second elongated slot and is fixedly attached via a securing means to an elongated tab such that the sliding movement of the elongated backing plate is coordinated with the sliding movement of the elongated tab and the elongated tab substantially covers the first elongated slot to avoid dirt collection and facilitate cleaning, leaving only one of two status labels visible at rest. The width of the elongated backing plate is substantially the width of the second elongated slot and the length of the elongated backing plate is substantially the length of the elongated tab such that the movement of the elongated tab is confined to the lengthwise direction of the elongated tab. In one embodiment of the present invention, the two lengthwise ends are biased towards the ledge such that sufficient resistance is exerted to the limit inadvertent sliding movement of the elongated tab. In addition, detents are provided to prevent accidental movements of the elongated tab. In other embodiments of the present invention, positive detents are provided to further prevent accidental movements of the elongated tab.

It is a primary object of the present invention to provide a medical task status checklist that is durable and effective in indicating and communicating the status of a medical task.

It is another object of the present invention to provide a medical task status checklist that is robust and able to withstand a great deal of trauma, such as twisting, pushing, pulling and impacting of the indicators without breaking the indicators or the panel on which they are affixed.

It is yet another object of the present invention to provide a medical task status checklist that is low cost, simple to design, simple to scale and manufacture and fabricable using conventional Computer Numerical Control (CNC), plastic molding and fastening technologies.

It is a further object of the present invention to provide a medical task status checklist that is clean, hygienic and can be easily sanitized to avoid contagion or transfer of infectious diseases.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification and claims. Also it is to be understood that the phraseology and terminology employed herein are for the purpose of description and should not be regarded as limiting.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
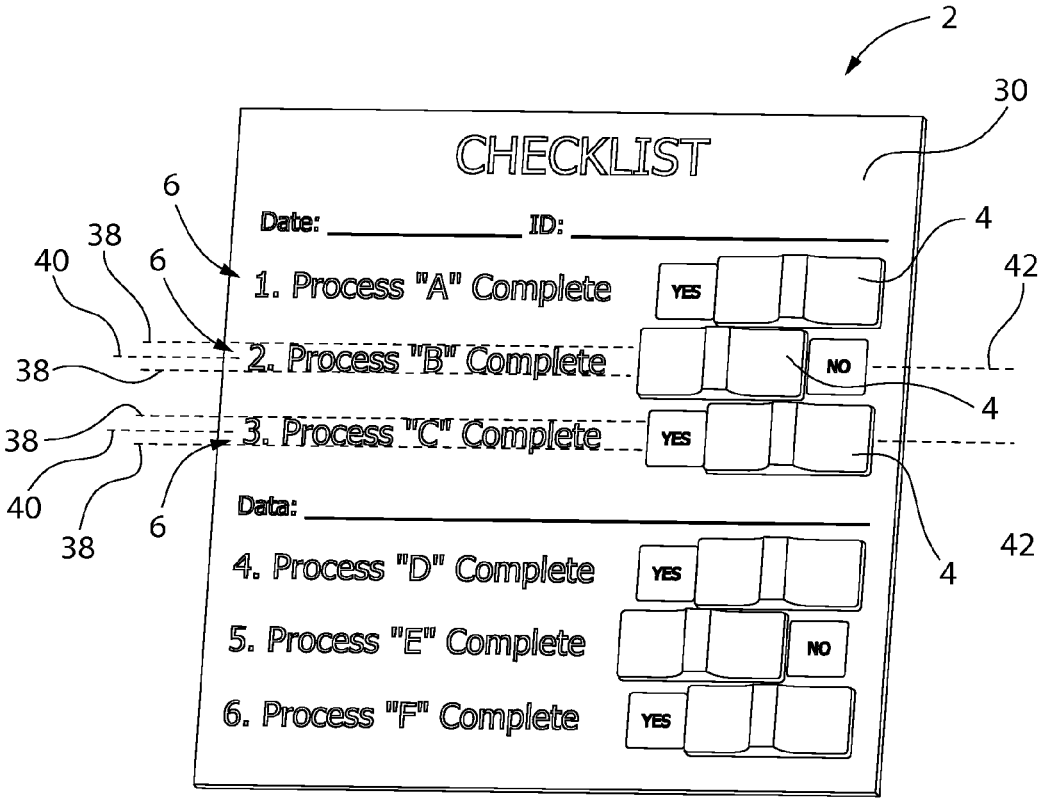
FIG. 1 is a front perspective view of a medical task status checklist of the present invention illustrating indicia disposed horizontally adjacent task status indicators.

The drawings are not to scale, in fact, some aspects have been emphasized for a better illustration and understanding of the written description.

PARTS LIST

2—medical task status checklist
4—two-status indicator
6—indicium
8—elongated tab
10—first status label
12—second status label
14—raised ridge
16—elongated backing plate
18—tongue of elongated backing plate
20—screw
22—first elongated slot
24—detent
26—not used
28—second elongated slot
30—panel
32—body of elongated tab
34—socket of elongated tab
36—edge of first elongated slot
38—extremity of indicium
40—horizontal central axis of indicium
42—horizontal central axis of indicator
44—front face of panel 30
46—rear face of panel 30
48—length of first elongated slot
50—length of second elongated slot
52—length of a status label
54—length of elongated tab
56—ledge
58—depth of second elongated slot
60—length of elongated backing plate
62—width of elongated tab
64—width of elongated backing
66—prior art checklist
68—frame including indicators of a prior art checklist
70—indicium corresponding to an indicator of frame 68
72—blocked out indicator
74—representative indicator corresponding to an indicium
76—tab
78—elongated track
80—step of preparing electronic template of two columns
82—step of arranging task status indicator/s
84—step of communicating electronic template to CNC machine
86—step of printing labels on panel
88—step of forming first elongated slot on panel
90—step of forming second elongated slot on panel
92—step of providing and positioning elongated tab over first elongated slot
94—step of providing and positioning elongated backing plate within second elongated slot
96—step of securing elongated backing plate to elongated slot
98—two-status indicator
99—two-status indicator
100—elongated tab
101—socket
102—push button
104—panel
106—spring
108—aperture
110—first status label
112—second status label
114—first elongated slot
116—detent receiver
118—detent receiver
120—stem
122—detent
124—elongated backing plate
126—aperture
128—latch
130—aperture
132—aperture
133—prong
134—screw
135—aperture
136—second elongated slot
137—prong receiving aperture
138—direction in which inwardly pointing force is applied to push button
140—direction in which longitudinal force is applied to elongated tab
142—status label
144—direction in which transverse force is applied to elongated tab
146—direction in which longitudinal force is applied to elongated tab
148—direction in which elongated tab returns to a position at rest
150—elongated tab
152—panel
154—elongated backing plate
156—detent receiver
158—detent receiver
160—detent
162—opening between spring members
164—spring member
166—spring member
168—screw
169—first elongated slot
170—second elongated slot
172—two-status indicator
174—elongated tab
176—elongated backing plate
178—male snap
180—female snap

182—shoulder of male snap
184—loop of female snap

PARTICULAR ADVANTAGES OF THE INVENTION

The present invention provides a medical task status checklist which is durable and capable of withstanding repeated use and abuse without breaking apart and one which clearly conveys the status of a medical task at a glance without requiring the user to look closely to determine which indicium corresponds to which indicator. The applicant discovered that when two adjacent indicia are disposed at a predetermined distance from one another, the likelihood of confusing one indicium with a non-corresponding indicator is greatly reduced. Such consideration of spacing between adjacent tasks is not made to most prior art indicators.

In contrast to prior art checklists, the present checklist would not crack or separate when subjected to such abuse just mentioned.

In contrast to the indicators disclosed in U.S. Pat. Nos. 3,343,294 and 4,703,712 which are not conducive to rapid wipe down due to exposed elongated slots on which debris can easily collect, the present invention provides indicators which protrude from the front face of a panel leaving no room for dirt and other contaminants to collect.

In contrast to the indicators disclosed in 4,703,712 or indicators which are attached to the front face of a panel, the present invention provides indicators which are durable and capable of withstanding repeated use without fail.

The present invention provides a durable medical task status checklist that is low cost, simple to design, manufacture and one that is fabricable using now common CNC technology.

DETAILED DESCRIPTION OF A PREFERRED EMBODIMENT

FIG. 1 is a front perspective view of a medical task status checklist 2 of the present invention illustrating indicia 6 disposed horizontally adjacent task status indicators 4. As shown, there are six tasks disposed on the front face of a panel 30, wherein a brief description of each task is stated in each indicium 6. In this example, an indicator 4 corresponding to an indicium 6 is disposed to the right therefrom. It should be noted that an indicator 4 may also be equivalently disposed to the left therefrom. Each indicium 6 comprises an overall height delineated by the extremities 38 of the indicium 6 and a horizontal central axis 40. Each two-status indicator 4 comprises a horizontal central axis 42 which is substantially coaxially aligned with the horizontal central axis 40 of its corresponding indicium 6. There may be other indicia on the panel such as the title of the checklist "CHECKLIST" which do not correspond to particular indicators 4. However, the placement of such indicia is less critical in that they are less likely to cause confusion as to the intent for an indicator 4.

Figure 1A:
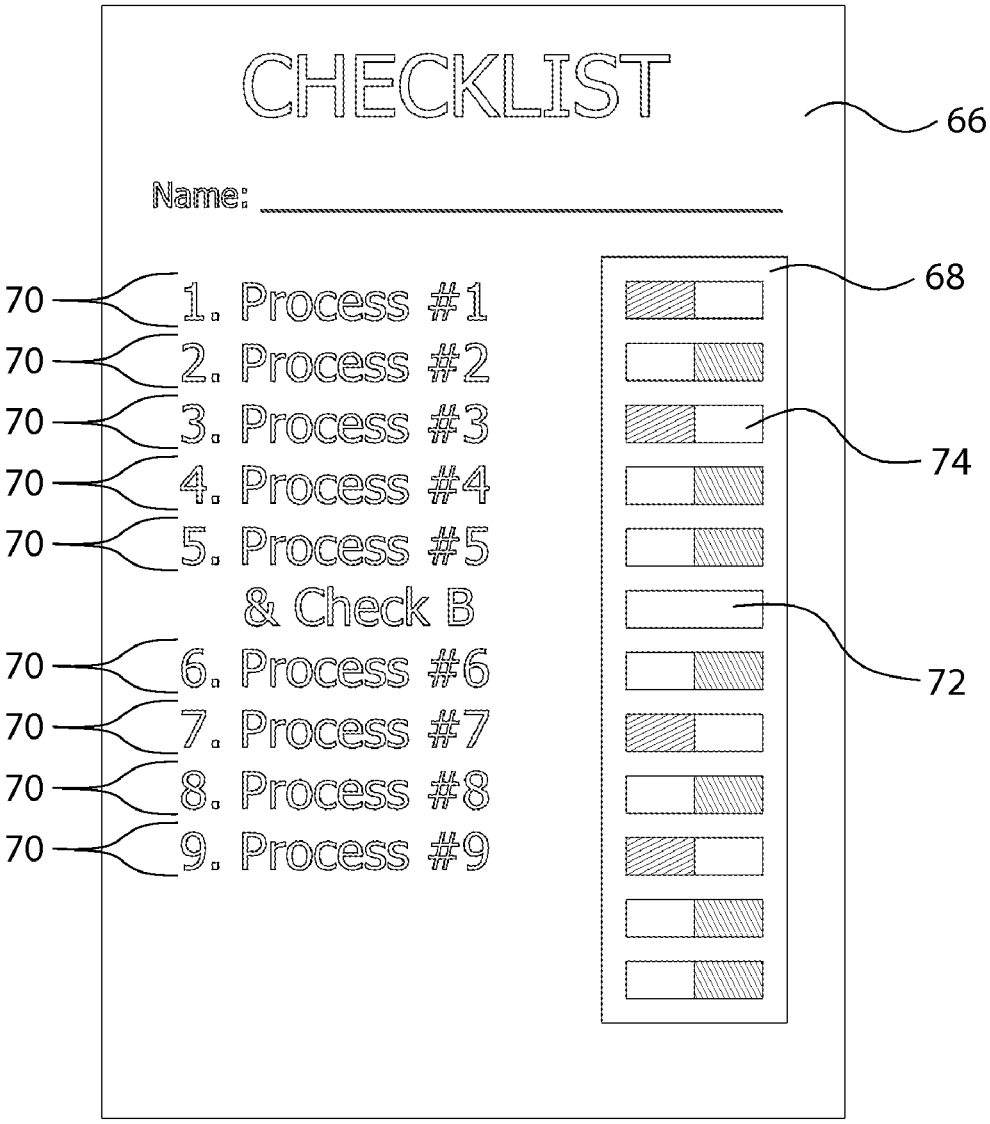
FIG. 1A PRIOR ART
FIG. 1A is a front orthogonal view of a prior art medical task status checklist.

FIG. 1A is a front orthogonal view of a prior art medical task status checklist 66 illustrating the use of a single pre-made vertically disposed frame 68 to include regularly spaced indicators 74. The prior art checklist 66 has essentially two columns where the left column comprises indicia 70 in the left column and a frame 68 in the right column to contain a plurality of two-status indicators 74. A problem arises when an indicium 70 spans more than one row. In this case, the indicium with wording "5. Process #5 & Check B" spans two rows. The pre-made indicator 72 falling on the second row is blocked out while the functionality of the pre-made indicator 74 of the first row is retained to indicate the status of this task. Disposing two indicators over two rows make deciphering a task status non-intuitive since it is unclear which indicium corresponds directly to an indicator. A user may eventually visually discern which indicia correspond to multiple indicators disposed over more than one row. In contrast, the present invention presents intuitive indicia-indicators pairing which reduces or eliminates guesswork. This is especially advantageous in a medical application where all efforts to eliminate errors is essential to patient care.

Figure 1B:
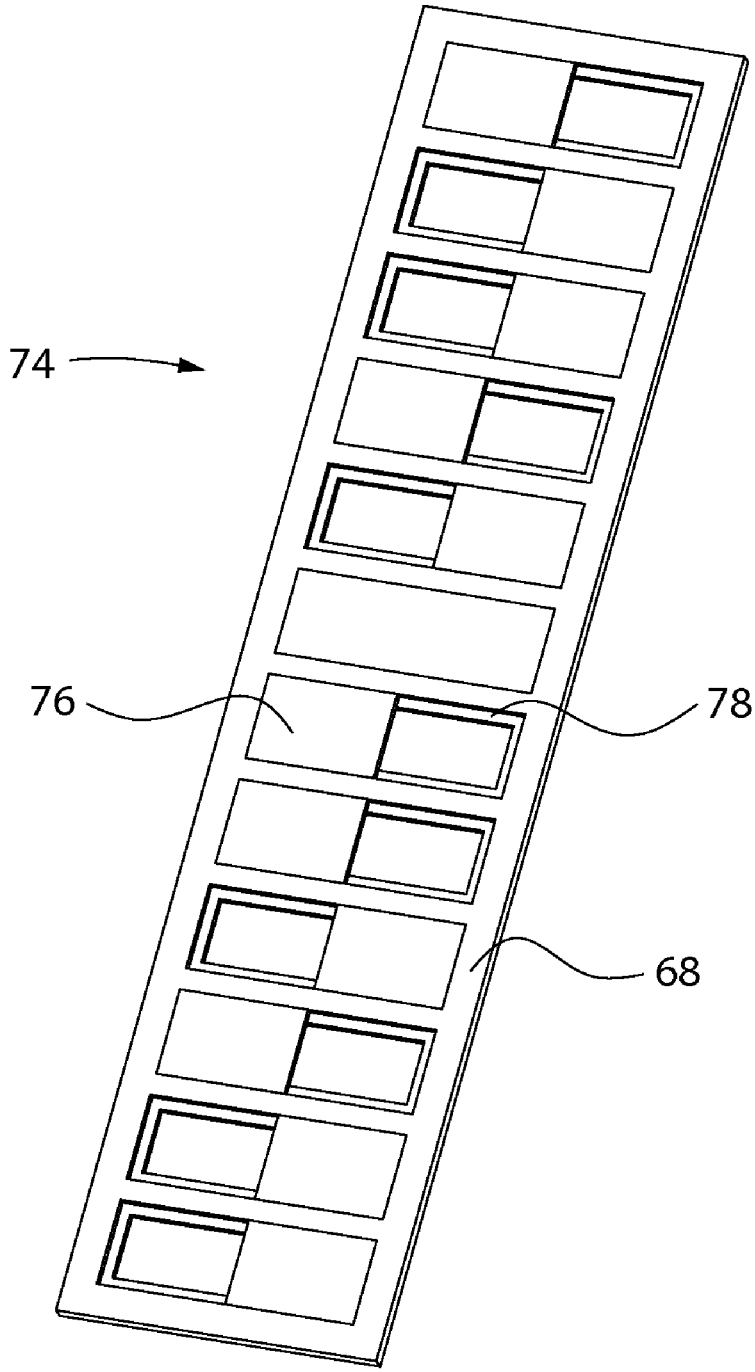
FIG. 1B PRIOR ART
FIG. 1B is a front perspective view of the indicator portion of the prior art medical task status checklist of FIG. 1A.

FIG. 1B is a front perspective view of the indicator portion of the prior art medical task status checklist of FIG. 1A. The frame 68 includes a plurality of premade two-status indicators 74. Each indicator 74 comprises a tab 76 configured to slide within an elongated track 78. In use, the frame 68 is attached to a panel by means of adhesive, attachment screws, and the like. Although such a slide can function as a basic indicator, the ease with which the elongated tracks 78 can collect debris and the difficulty in removing debris collected in the tracks 78 make this type of task status indicator 74 unsuitable to meet the requirements of a clean or sterile environment.

Figure 2:
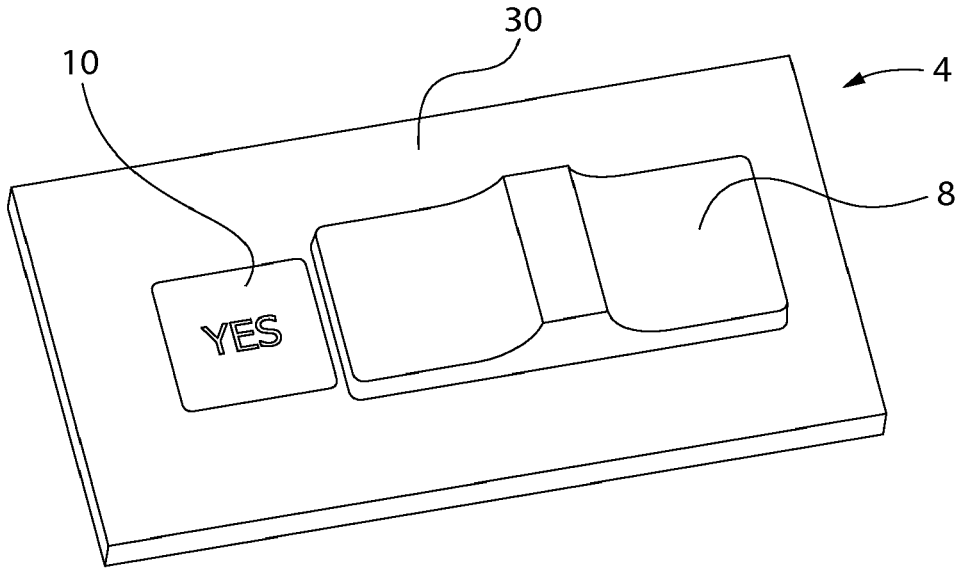
FIG. 2 is a front perspective view of a task status indicator of the present invention illustrating the task status indicator indicating a first status.

FIG. 2 is a front perspective view of a task status indicator 4 of the present invention illustrating the task status indicator indicating a first status. As shown, there is disposed a first status label 10 on the left end of the indicator 4 which is revealed in its entirety to clearly indicate a status. In this case, the first status label 10 is labeled "Yes." In this indicator position, a second status is entirely concealed by an elongated tab 8 so as to aid a user in ascertaining the status the indicator conveys.

Figure 3:
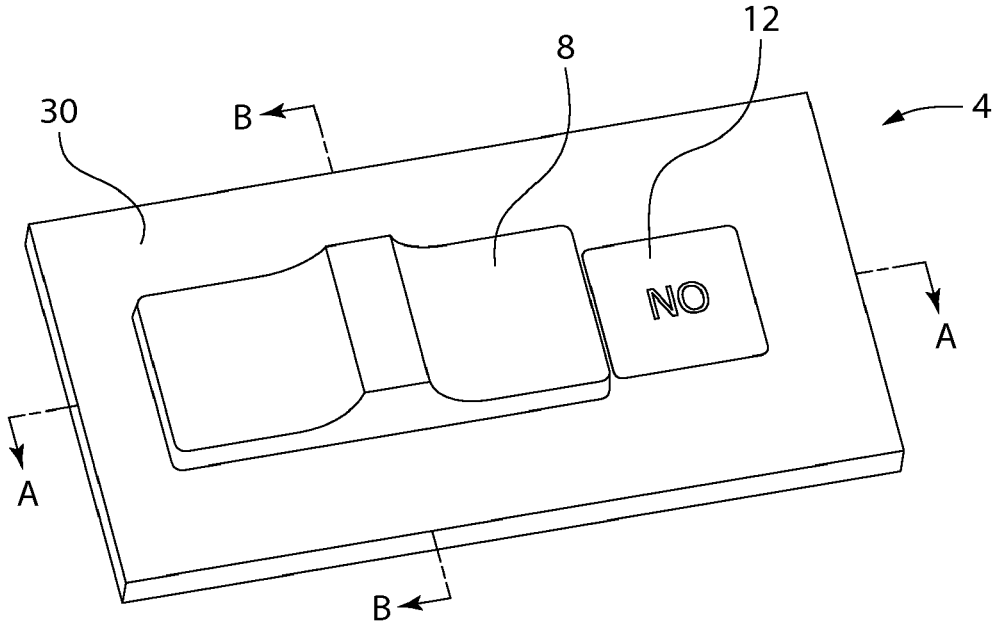
FIG. 3 is a front perspective view of a task status indicator of the present invention illustrating the task status indicator indicating a second status.

FIG. 3 is a front perspective view of a task status indicator of the present invention illustrating the task status indicator indicating a second status. As shown, there is disposed a second status label 12 on the right end of the indicator 4 which is revealed in its entirety to clearly indicate a status. In this case, the second status label 12 is labeled "No." In this indicator position, the first status 10 of FIG. 2 is entirely concealed by the elongated tab 8. In one preferred embodiment, the elongated tab 8 is opaque, thereby capable of concealing a status label.

Figure 4:
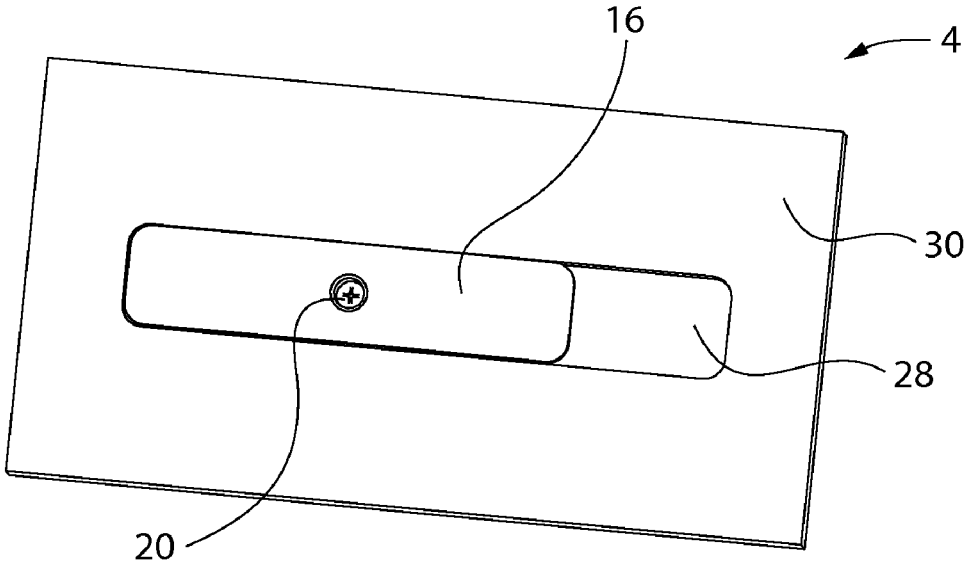
FIG. 4 is a rear perspective view of a task status indicator of the present invention illustrating an elongated plate disposed in sliding engagement with a second elongated slot.

FIG. 4 is a rear perspective view of a task status indicator of the present invention illustrating an elongated backing plate 16 disposed in sliding engagement with a second elongated slot 28 whose function is described elsewhere in this application. An attachment screw 20 is shown disposed centrally on the elongated backing plate 16.

Figure 5:
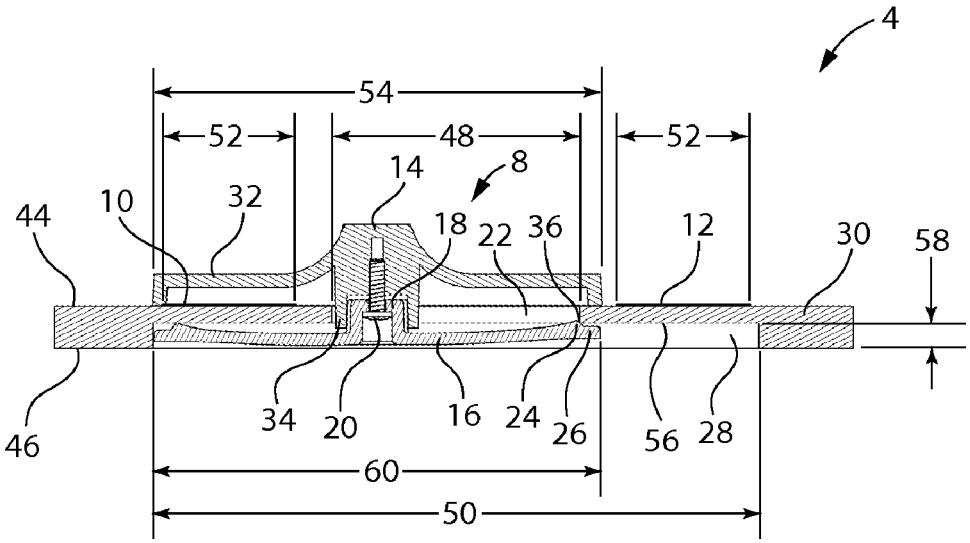
FIG. 5 is a side orthogonal sectional view of a task status indicator of the present invention taken along line AA of FIG. 3 illustrating the task status indicator indicating a first status.
Figure 6:
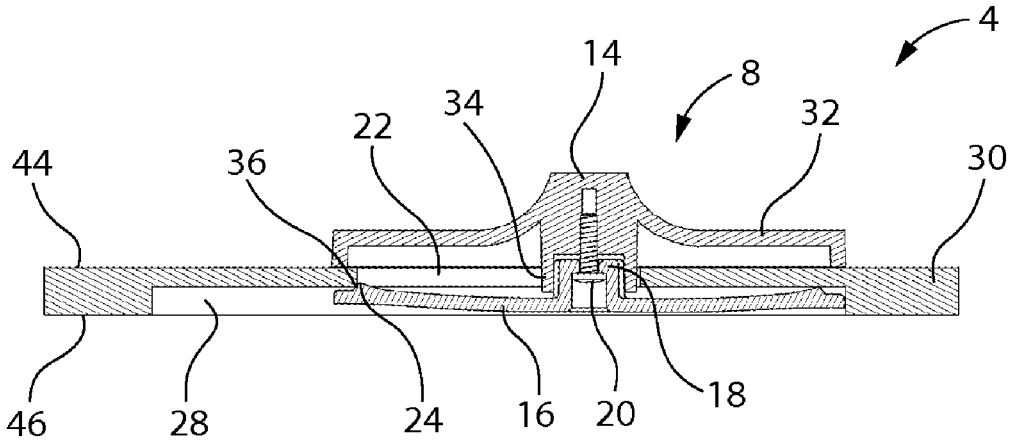
FIG. 6 is a side orthogonal sectional view of a task status indicator of the present invention taken along line AA of FIG. 3 illustrating the task status indicator indicating a second status.

FIGS. 5 and 6 are side orthogonal sectional views of a task status indicator of the present invention taken along line AA of FIG. 3 illustrating the task status indicator indicating the first and second statuses. The indicator 4 is geometrically symmetric about lines AA and BB of FIG. 3. The indicator 4 comprises a first elongated slot 22 and a second elongated slot 28 concentrically but opposingly disposed on the front face 44 and the rear face 46 respectively of the panel 30. The first elongated slot 22 has a length 48, width and depth. The elongated tab 8 has a length 54 and a width that are sized such that the elongated tab 8 sufficiently conceals the first elongated slot 22 and one of the two status labels 10, 12. Therefore, the length 54 of the elongated tab must be at least the sum of the length 48 of the first elongated slot 22 and the length 52 of a status label 10, 12. The elongated tab 8 has a centrally disposed finger hold formed as a raised ridge 14 which tapers to a flat body 32 on each side of the raised ridge 14. Below the raised ridge 14, there is disposed a socket configured for receiving a tongue 18 disposed on an elongated backing plate 16. The second elongated slot 28 has a length 50, a width and a depth 58. The width of the first elongated slot 22 is slightly smaller than the width of the second elongated slot and the length of the first elongated slot is substantially smaller than the length of the second elongated slot such that a ledge is formed around the periphery of the second elongated slot 28. The first elongated slot 22 appears as a hole to a viewer viewing from the front face 44 and a hole with a ledge to a viewer viewing from the rear face 46. The indicator 4 further comprises two status labels 10, 12, each disposed adjacent each lengthwise end of the first elongated slot 22.

The elongated backing plate 16 comprises two lengthwise ends, a length 60, a width and a thickness and is configured to slide within the second elongated slot 28. The elongated backing plate 16 is fixedly attached via a screw that is positioned through an aperture disposed at the tip the tongue 18 to the elongated tab 8 such that the sliding movement of the elongated backing plate 16 is coordinated with the sliding movement of the elongated tab 8 and the elongated tab 8 substantially covers the first elongated slot 22 to avoid dirt collection and facilitate cleaning, leaving only one of two status labels 10, 12 visible at rest. The two lengthwise ends of the elongated backing plate 16 are slightly curved and biased towards the ledge 56. It should be appreciated that various other means of attaching the elongated tab 8 to elongated backing plate 16 are available in the fastening arts provided that relative rotation between the elongated tab 8 and the elongated backing plate 16 is prevented when the two are affixed together.

To further prevent the accumulation of debris on the device, the two-status indicator preferably has a smooth peripheral surface and is devoid of openings or depressions.

When installed, the elongated backing plate 16 acts as a spring and applies slight resistance in the sliding movement of the elongated tab 8 to prevent inadvertent movement due to vibration or accidental contact with the elongated tab 8. The thickness of the elongated backing plate 16 is configured such that the elongated backing plate 16 is fully contained within the second elongated slot 28 so that the elongated backing plate 16 can function without interfering with a support on which the panel 30 is mounted. A non-protruding rear face 46 enables flush mounting of the panel 30 on a wall, a support system and the like. Various other suitable securing means may be used to secure the elongated tab 8 to the elongated backing plate 16. The elongated backing plate 16 further comprises a detent 24 disposed substantially at each of its two lengthwise ends. The detents 24 are integrally formed with the elongated backing plate 16, though not necessarily. In an embodiment not shown, the detent may alternately be formed as part of the first or second elongated slot 22 while a detent receiver is formed in the elongated backing plate 16.

When pushed to a travel limit, one lengthwise end of the elongated backing plate 16 comes in contact with one lengthwise end of the second elongated slot 28, while the opposite lengthwise end of the elongated backing plate 16 comes in substantial contact with a lengthwise end of the first elongated slot 22. The detent 24 is a protrusion that when combined with a lengthwise end of the elongated backing plate 16, forms a curved surface which engages one lengthwise end of the elongated backing plate 16 to an edge of a lengthwise end of the first elongated slot 22. Such engagement is possible due to the biased lengthwise end of the elongated backing plate 16 which urges the curved surface into a corner of the lengthwise end of the first elongated slot 22 as the lengthwise end of the elongated backing plate 16 approaches the edge. With detent 24, a larger initial force of at least 0.4 lbs is required to cause the elongated tab 8 to move from a travel limit, thereby detenting the elongated tab and further preventing inadvertent sliding movement due to vibration or accidental contact with the elongated tab 8. The advantageous features of the present invention lie in the simplicity of the sliding mechanism which includes an elongated tab 8 coupled with an elongated, spring loaded and detented backing plate 16 which slides in an elongated slot 28 formed in a panel 30.

The panel 30 is constructed from a material that is lightweight but structurally sound such as Polyvinyl Chloride, Acrylic and the like and has a thickness ranging from 0.2 to 0.4 inches. Though not required, elongated slots 22, 28 are typically formed by milling. The elongated tab 8 and its mating elongated backing plate 16 are typically made of Polystyrene, Acrylonitrile Butadiene Styrene and the like. In one embodiment, the elongated backing plate 16 is formed without detents such that the same is constructed from a simpler mold. In cases where the elongated backing plate 16 are constructed from shape memory metal, the elimination of detents eliminates the need for a stamping step or mold feature that is required to provide the detents, thereby offering an opportunity to reduce costs associated with molding making or manufacturing process of the elongated backing plate 16.

Figure 7:
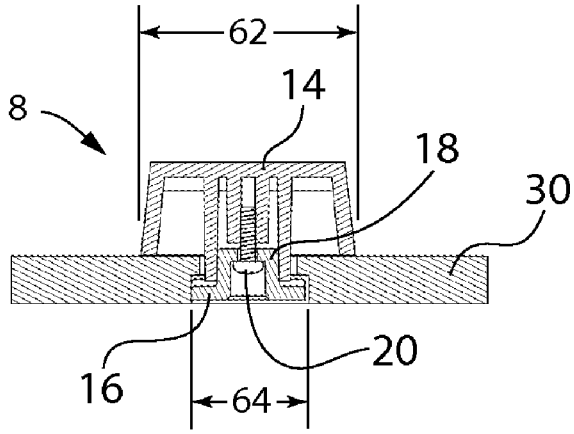
FIG. 7 is a side orthogonal sectional view of a task status indicator of the present invention taken along line BB of FIG. 3 illustrating the task status indicator indicating a status.

FIG. 7 is an orthogonal sectional view of a task status indicator of the present invention taken along line BB of FIG. 3 illustrating the task status indicator indicating a status. The width 62 of the elongated backing plate 16 is substantially the width of the second elongated slot 28 such that the elongated backing plate 16 can slide well within the second elongated slot 28. It is preferable, though not required, that the length 60 of the elongated backing plate 16 be substantially the length 54 of the elongated tab 8 such that there is sufficient length of elongated backing plate 16 to prevent tendency of the sliding movement of the elongated tab 8 to deviate from an intended path as delineated by the second elongated slot 28 and to ensure that the movement of the elongated tab is confined to the lengthwise direction of the elongated tab 8 and the indicator is durable, especially when the elongated tab 8 is pushed in a direction other than the intended path, i.e., in the lengthwise direction of the elongated tab 8. The word "durable" as used herein generally describes a checklist that is capable of withstanding cumulative repeated use of 20,000 actuations on a task status indicator without experiencing performance degradation and its panel capable of withstanding a front or side impact force of at least 30 lbs, torsion force of at least 20 in-lbs, or a force attempting to separate the a task status indicator from the panel of at least 20 lbs without damage.

Figure 8:
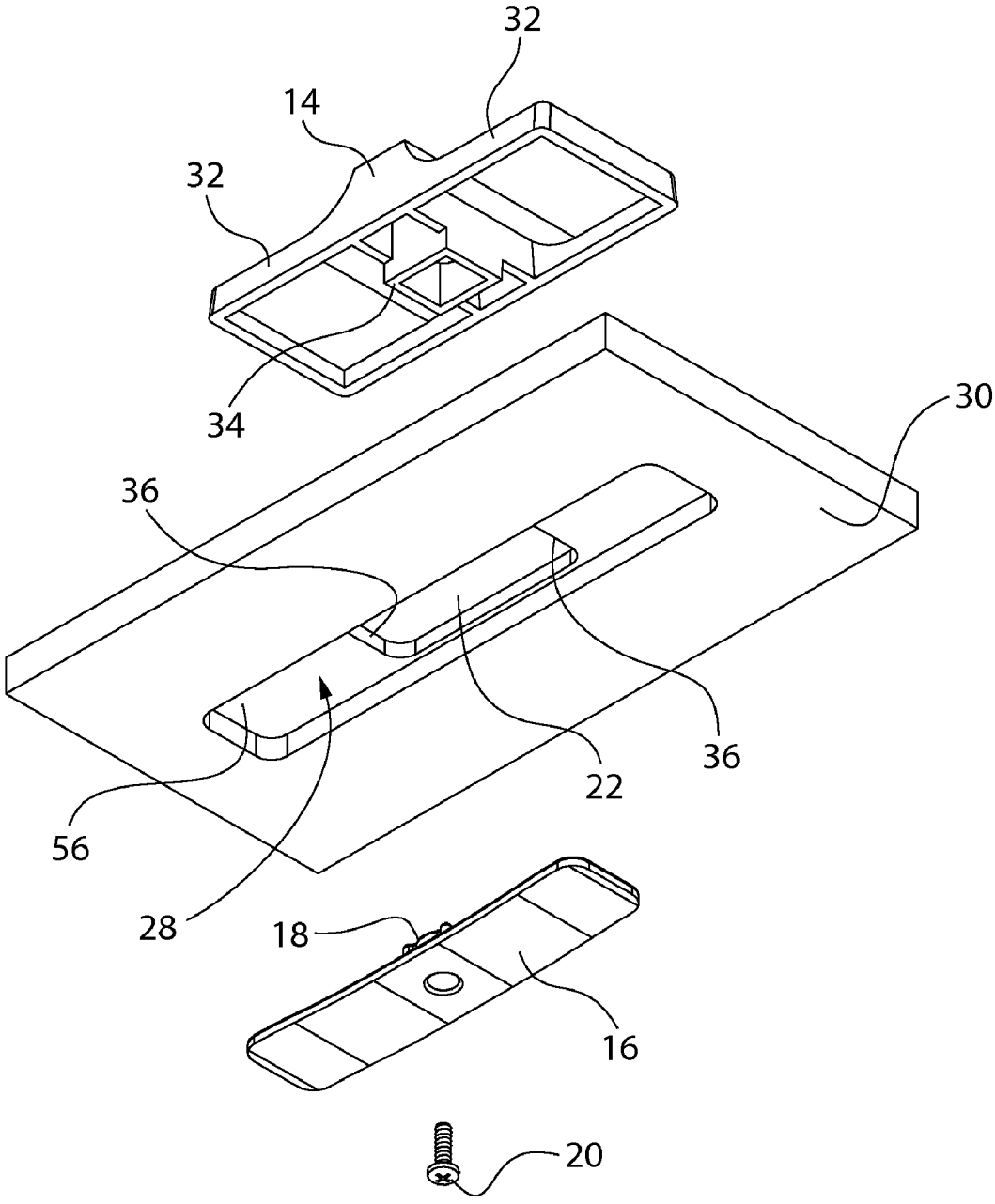
FIG. 8 is a bottom perspective exploded view of a task status indicator of the present invention illustrating the components that make up the task status indicator.
Figure 9:
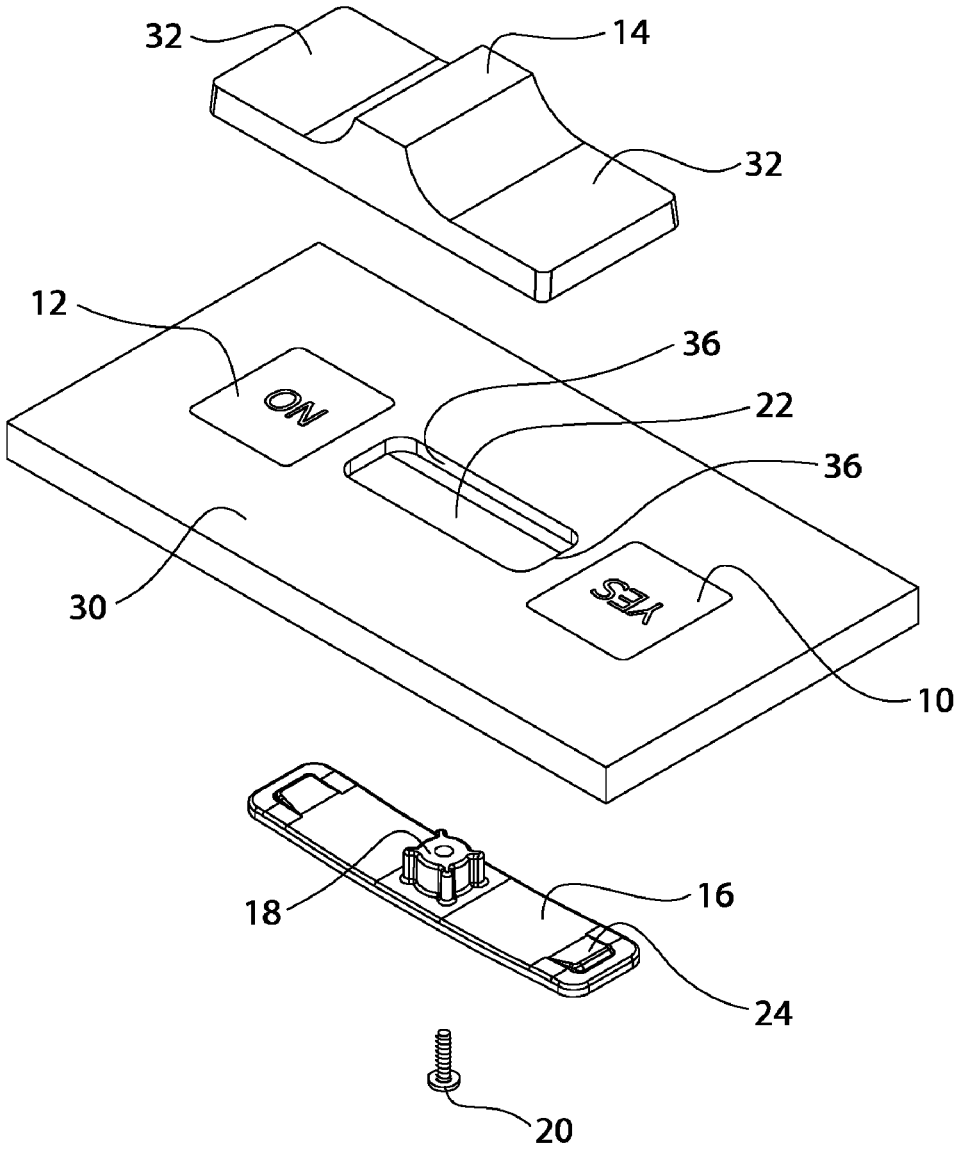
FIG. 9 is a top perspective exploded view of a task status indicator of the present invention illustrating the components that make up the task status indicator.

FIGS. 8 and 9 are bottom and top perspective exploded views, respectively, of a task status indicator of the present invention illustrating the components that make up the task status indicator. The socket 34 is generally rectangular and configured to receive the tongue 18 having a mating rectangular profile, which when mounted within the socket 34, prevents relative rotation between the elongated tab 8 and the elongated backing plate 16.

Figure 10:
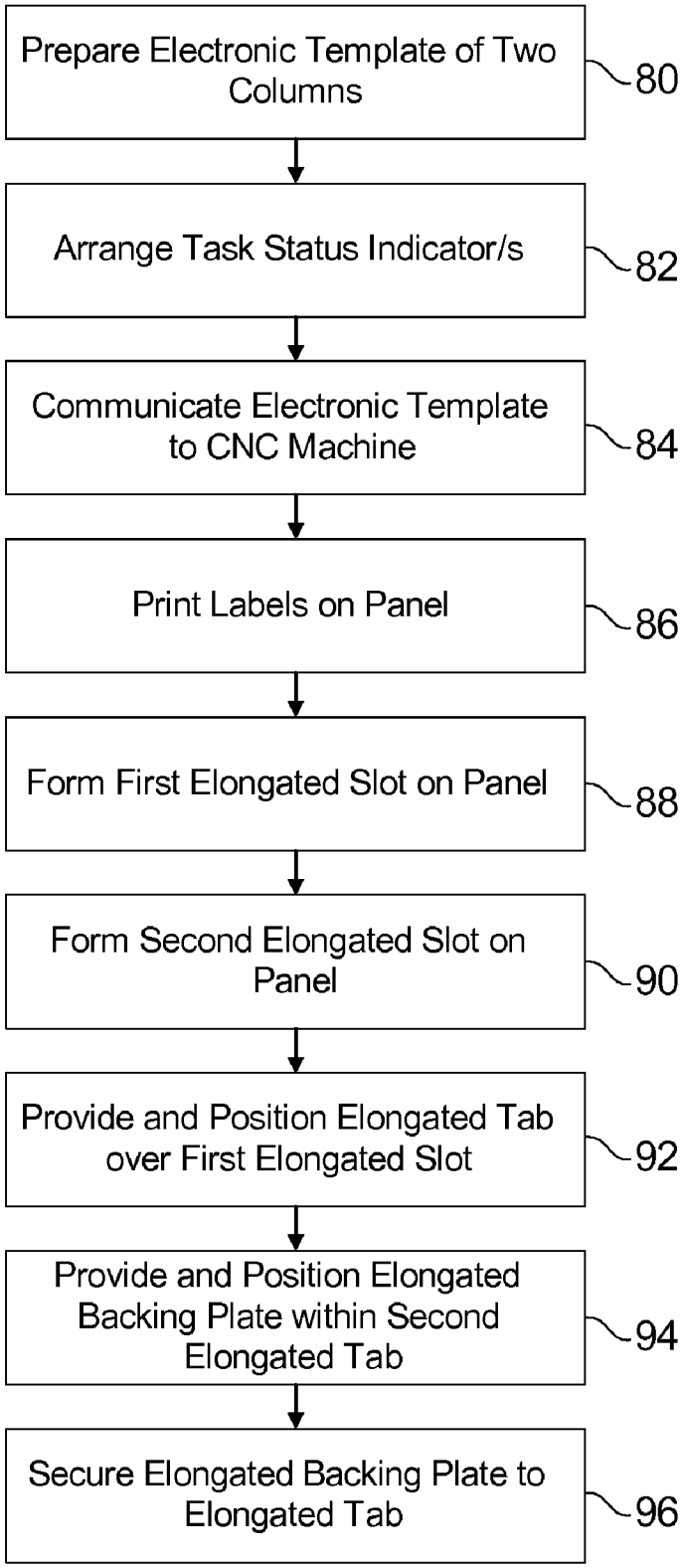
FIG. 10 is a flowchart illustrating the steps used for constructing a checklist of the present invention.

FIG. 10 is a flowchart illustrating the steps used for constructing a checklist of the present invention. A medical task status checklist of the present invention comprises a panel having at least one medical task status indicator where the at least one task medical task status indicator has an indicium substantially horizontally aligned with an indicator. In constructing a medical task status indicator which shows clearly the status of a task and one that is simple to construct, a panel is modified such that slots for mounting indicator tabs 8 may be assembled on and built into the panel. A first step 80 of constructing a checklist of the present invention includes preparing an electronic template having cells defined by two adjacent columns and at least a row, wherein each cell on the left column of the two adjacent columns is populated with an indicium while each cell on the right column is populated with an indicator. A second step 82 includes arranging the at least one task status indicator by simultaneously moving each populated cell on the left column of the two adjacent columns with its associated populated cell on the right column of the two adjacent columns. A third step 84 includes communicating the electronic template to a Computer Numerical Control (CNC) machine in which a panel is positioned as a blank such that at least one indicator is formed on one of the two adjacent columns of the panel. A fourth step 86 includes printing a label on each lengthwise end of the indicator and an indicium on the corresponding row on the opposing column. A fifth step 88 includes forming a first elongated slot having a length and a width in the front face of the panel and longitudinally aligned with the indicator's horizontal central axis. A sixth step 90 includes forming a second elongated slot having a length and a width in the rear face of the panel and centrally disposed along the length and width of the first elongated slot where the width of the first elongated slot is slightly smaller than the width of the second elongated slot and the length of the first elongated slot is substantially smaller than the length of the second elongated slot such that a ledge is formed around the periphery of the second elongated slot. In should be appreciated that the order in which first elongated slot and second elongated slot are formed is interchangeable. A seventh step 92 includes providing and positioning an elongated tab to sufficiently cover the first elongated slot at all times and one status label to avoid dirt collection and facilitate cleaning, leaving only one of two status labels visible at rest. An eighth step 94 includes providing and positioning an elongated backing plate within the second elongated slot. A ninth step 96 completes the process of constructing a checklist of the present invention by securing the elongated backing plate to the elongated tab such that the movement of the elongated backing plate is coordinated with the movement of the elongated tab. Alternatively, the fourth step 86 can be performed after the fifth step 88 but before the seventh step 92.

Other Embodiments

Figure 11:
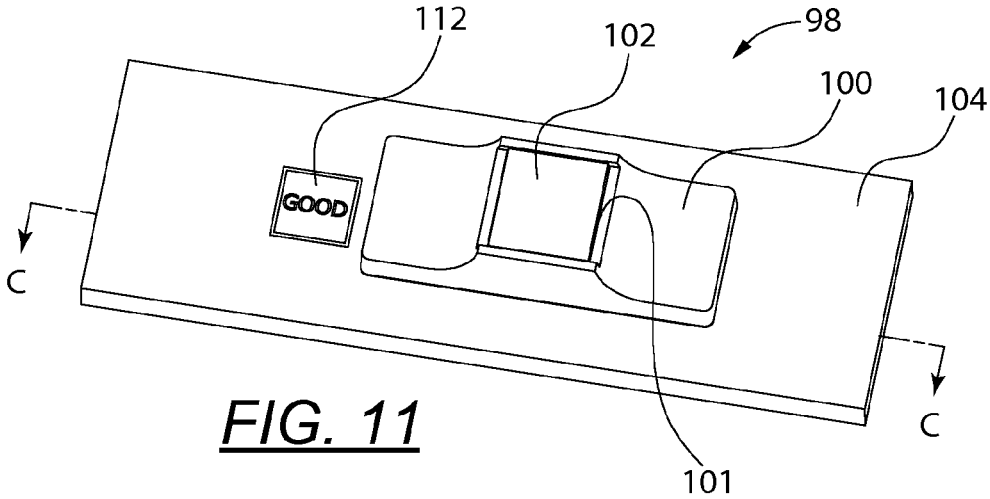
FIG. 11 is a front perspective view of another embodiment of a task status indicator of the present invention illustrating the task status indicator indicating a second status.

FIG. 11 is a front perspective view of another embodiment of a task status indicator 98 of the present invention illustrating the task status indicator 98 indicating a second status 112 when disposed on a panel 104. This embodiment of the task status indicator comprises a mechanism that positively locks an elongated tab 100 in place to avoid accidental movement. When locked in place, a trigger such as that provided by a push button 102 centrally disposed on the elongated tab 100 needs to be depressed in order for the elongated tab 100 to be slideably moved.

Figure 12:
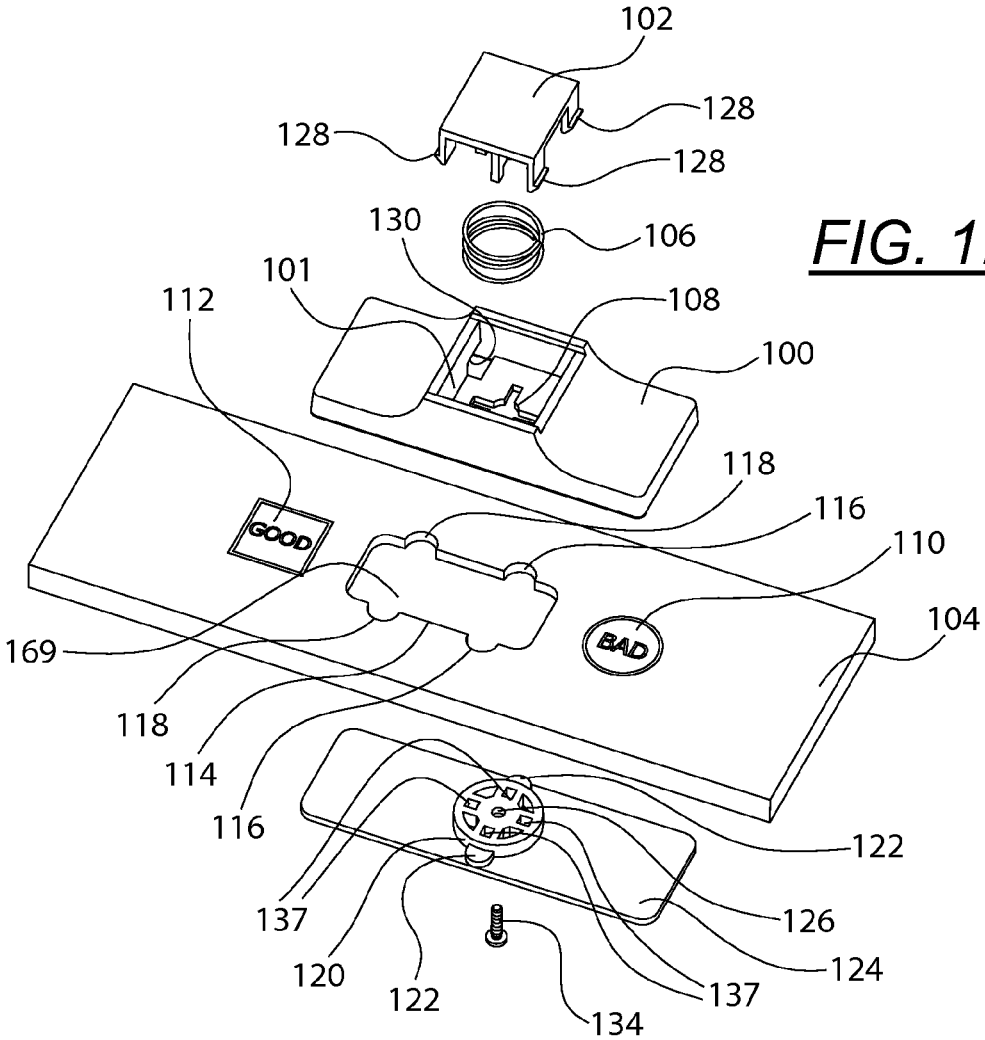
FIG. 12 is a top perspective exploded view of the task status indicator shown in FIG. 11.
Figure 13:
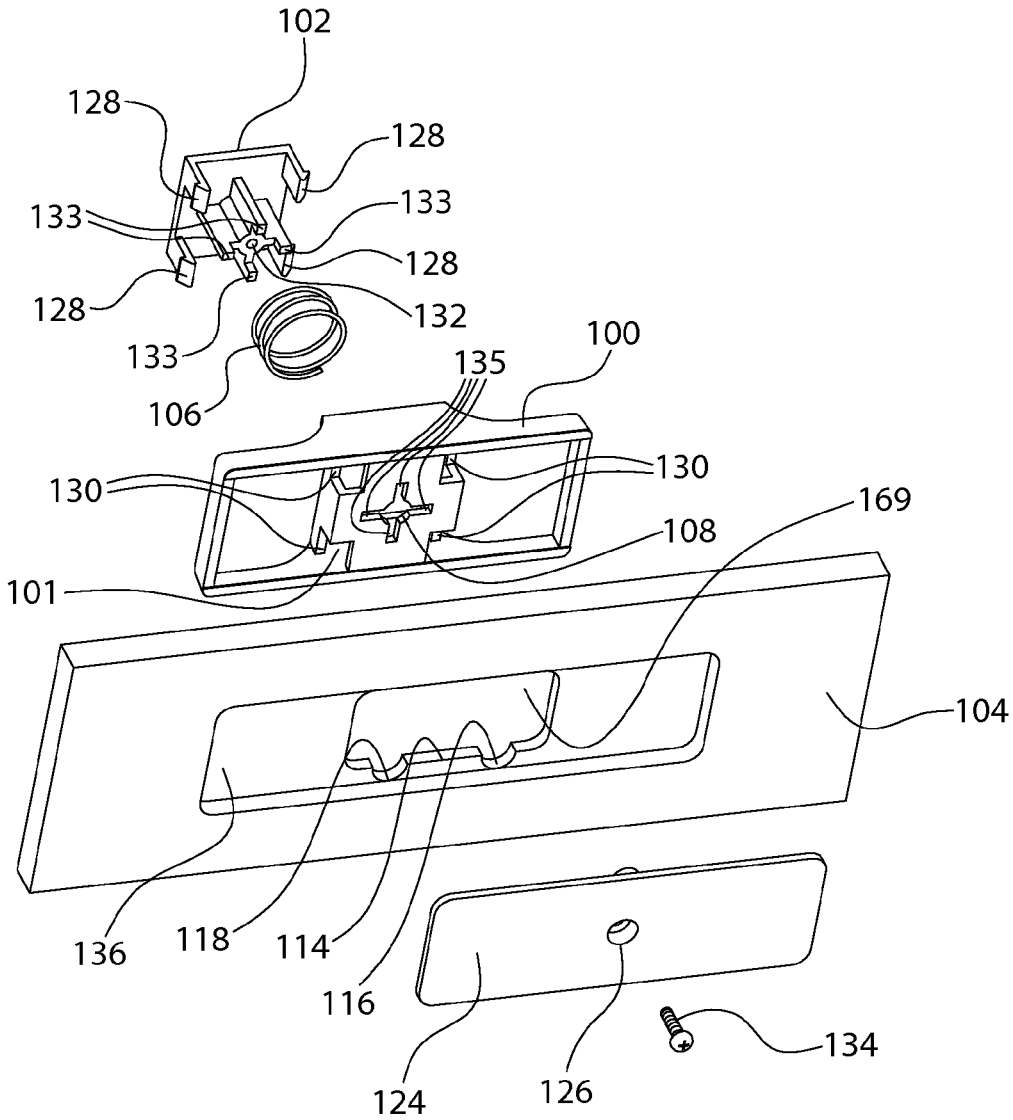
FIG. 13 is a bottom perspective exploded view of a task status indicator shown in FIG. 11.

FIGS. 12 and 13 are top and bottom perspective exploded views, respectively, of the task status indicator 98 shown in FIG. 11. The task status indicator 98 comprises a slideable elongated tab 100 having a detent means when operably mounted with respect to the panel 104. There are two slots 114, 136 disposed in the panel 104, much like the panel disclosed in FIG. 8. A first elongated slot 114 and a second elongated slot 136 are disposed on the front face and the rear face respectively of the panel 104. The detent means comprises a resilient push button 102 that is fixedly attached to a pair of detents 122 and centrally disposed within the elongated tab 100 and selectively engaged to one of two pairs of detent receivers 116, 118. The elongated tab 100 comprises a socket 101 that is centrally disposed and configured to receive the push button 102. The push button 102 comprises a flat surface on one end for receiving a user's finger, a plurality of latches 128 for mating with a matching number of apertures 130 disposed within the socket 101 and a plurality of prongs 133 for mating with a matching number of prong receiving apertures 137, both on the opposing end thereof. Referring to FIG. 13, the push button further comprises an aperture 132 for receiving a screw 134 and the socket 101 further comprises an aperture 108 at its base for enabling the screw 134 through in order to secure the push button 102. There are further disposed a plurality of apertures 135 which enable the prongs 133 through to mate with a plurality of prong receiving apertures 137 disposed on a centrally disposed stem 120 of the elongated backing plate 124. Referring to FIG. 12, there is further provided a pair of detents 122 aligned in the transverse direction of the elongated backing plate 124 that is configured to mate with one of two pairs of detent receivers 116, 118, each disposed in the transverse direction on towards each end of the first elongated slot 114. The socket 101 comprises a matching number of apertures 130 for receiving the latches 128. In use, a spring 106 is first seated in the socket 101 of the elongated tab 100 before the push button 102 is positioned over the spring within the socket 101 with the flat surface of the push button 102 facing the user. The elongated tab 100 is then positioned over and longitudinally aligned with the first elongated slot 114. The elongated backing plate 124 is then brought into the second elongated slot 136 and longitudinally aligned thereof with the side where the stem 120 is disposed facing the panel 104. The push button 102 is positioned such that the prongs are contained within the lumen of the spring 106 and delineates the lumen thereof. The apertures 132, 108, 126 are aligned such that a fastener such as a screw 134 can be inserted and fastened to secure the push button 102 to the elongated backing plate 124. Other equivalent fastening means may also be used provided such construction does not result in indicators having exposed slots to the environment for contamination. In the mounted position, the hooked ends of the latches 128 engage the edges of the apertures 130, preventing the push button 102 from being dislodged from the elongated tab 100. At rest, the flat surface of the push button 100 is disposed substantially flush with the top longitudinal edges of the socket 101. The push button 102 is permitted to move in a direction substantially perpendicular to the sliding movement of the elongated tab 100. The spring 106 exerts a slight pressure against the push button 102 and the elongated tab 100, propping the push button 102 to one limit of travel within the socket 101.

Figure 14:
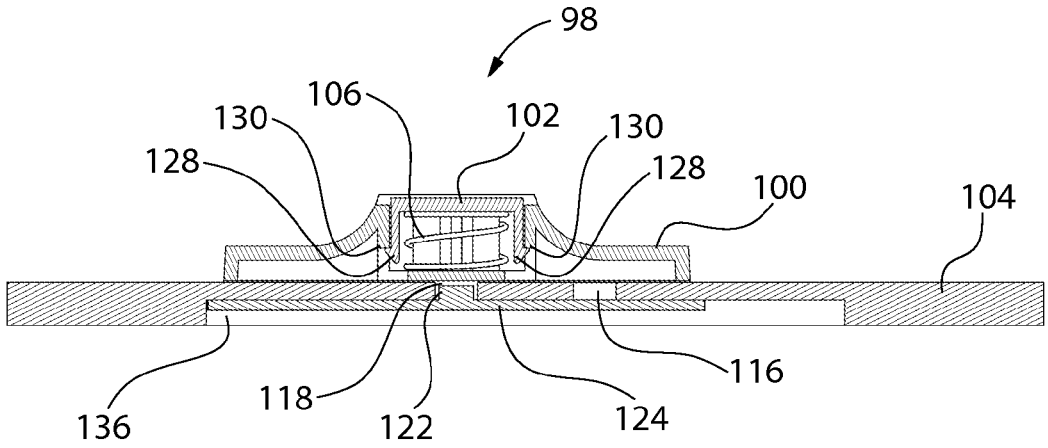
FIG. 14 is a side orthogonal sectional view of a task status indicator of the present invention taken along line CC of FIG. 11 illustrating the task status indicator indicating a second status.

FIG. 14 is a side orthogonal sectional view of a task status indicator of the present invention taken along line CC of FIG. 11 illustrating the task status indicator indicating a second status. At rest, the task status indicator 98 is positioned such that it indicates a status as indicated by the status label (110 or 112) the elongated tab 100 reveals. As shown, a detent 122 of the elongated backing plate 124 is disposed in and mated with a detent receiver 118. When disposed in this position, the position of the elongated backing plate 124 is positively prevented from being altered.

Figure 15:
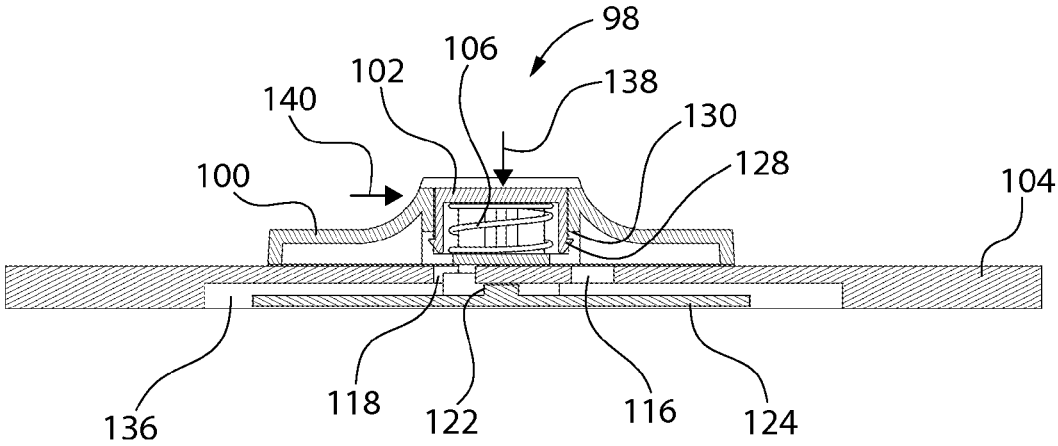
FIG. 15 is a side orthogonal sectional view of a task status indicator of the present invention taken along line CC of FIG. 11 illustrating the task status indicator being moved from a second status position to a first status position.

FIG. 15 is a side orthogonal sectional view of a task status indicator of the present invention taken along line CC of FIG. 11 illustrating the task status indicator being moved from a second status position to a first status position. In order to disengage the detent 122 from the detent receiver 118, the push button 102 is first depressed in the direction 138 substantially perpendicular to the slideable direction of the elongated tab 100 thereby dislodging the detent 122 from the detent receiver 118 such that the elongated tab 100 can be slideably moved in direction 140 while the push button 102 is concurrently held down in direction 138. The elongated backing plate 124 is configured such that when the push button 102 is depressed, the elongated backing plate 124 is confined within the second elongated slot 136.

Figure 16:
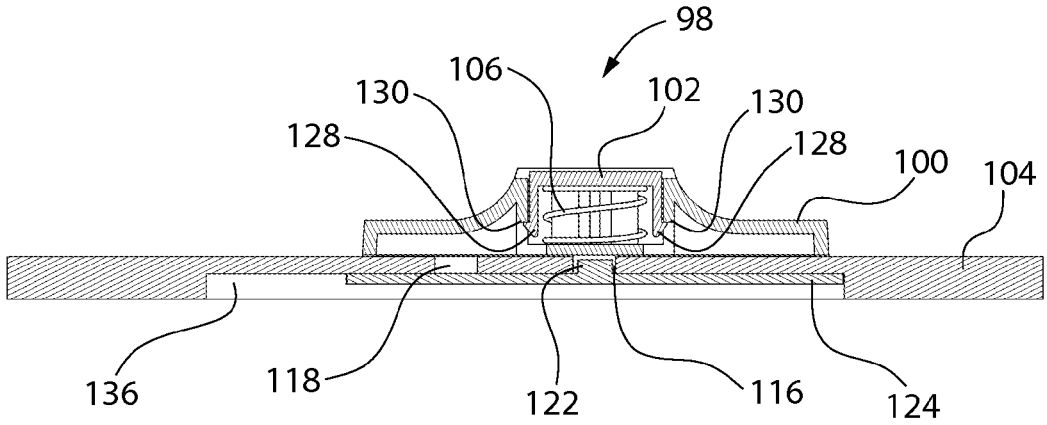
FIG. 16 is a side orthogonal sectional view of a task status indicator of the present invention taken along line CC of FIG. 11 illustrating the task status indicator indicating a first status.

FIG. 16 is a side orthogonal sectional view of a task status indicator of the present invention taken along line CC of FIG. 11 illustrating the task status indicator indicating an opposing status of the status indicated in FIG. 14, i.e. first status. The detent 122 is again engaged in a detent receiver 116. It should be noted the push button 102 is once again in the undepressed position.

Figure 17:
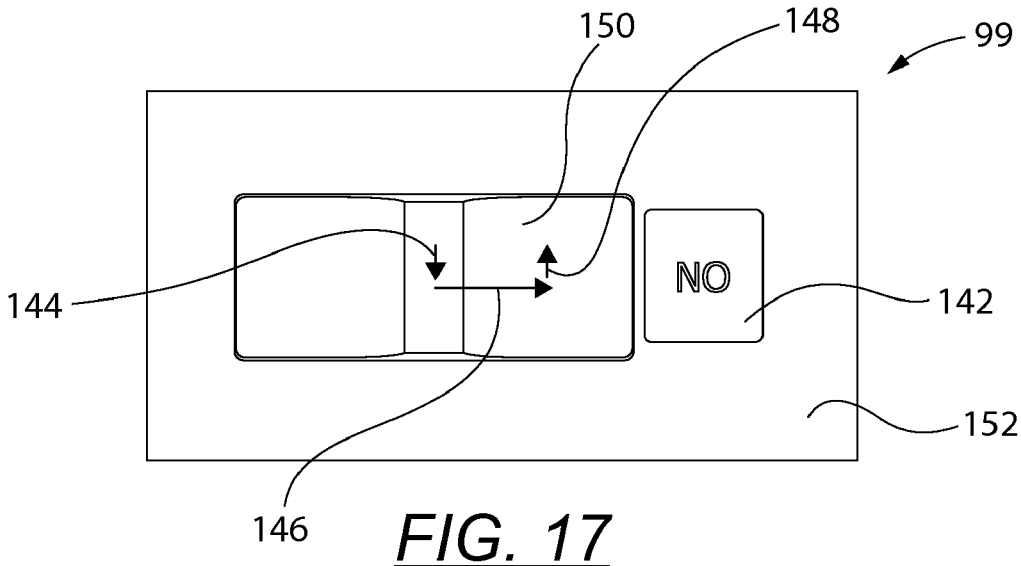
FIG. 17 is a top orthogonal view of yet another embodiment of a task status indicator of the present invention illustrating the task status indicator being moved from a second status position to a first status position.

FIG. 17 is a top orthogonal view of yet another embodiment of a task status indicator of the present invention illustrating the task status indicator 99 being moved from a second status position to a first status position. This embodiment is different from the embodiment depicted in FIGS. 11-16 in that the detent means is configured such that it requires a different motion to disengage. In order to disengage, a force directed in direction 144, i.e., transverse to the longitudinal axis of the indicator 99 is applied to the elongated tab 150. While holding down the elongated tab 150 with the force applied in direction 144, the elongated tab 150 is then moved in the direction 146, i.e., in the lengthwise direction of the indicator 99 to conceal a first status label 142 and revealing a second status label disposed on the opposing end of the indicator 99. Once the elongated tab 150 has been moved to its travel limit in direction 146, it is released such that the elongated tab 150 returns to its position at rest in direction 148.

Figure 18:
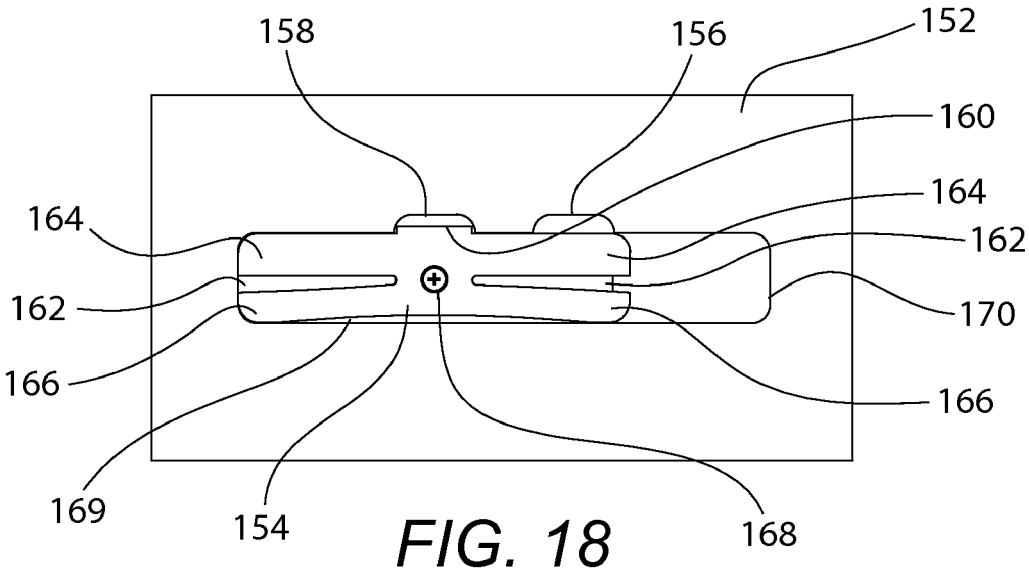
FIG. 18 is a bottom orthogonal view of the embodiment of FIG. 17 illustrating a detent mechanism of the task status indicator that is positioned to reveal a first status label.
Figure 19:
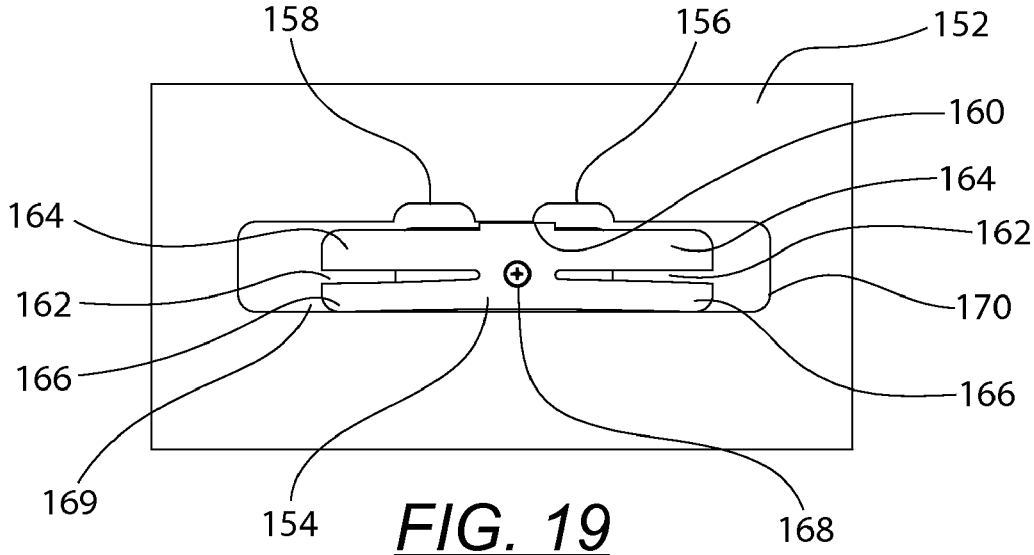
FIG. 19 is a bottom orthogonal view of the embodiment of FIG. 17 illustrating a detent means of the task status indicator that is moved from one position to another.

FIG. 18 is a bottom orthogonal view of the embodiment of FIG. 17 illustrating a detent mechanism of the task status indicator 99 that is positioned to reveal a first status label. FIG. 19 is a bottom orthogonal view of the embodiment of FIG. 17 illustrating a detent means of the task status indicator that is being moved from one position to another. The elongated tab 150 disposed on the front face of the panel 152 is substantially similar to the elongated tab of FIG. 8. The indicator 99 comprises a first elongated slot 169, a second elongated slot 170 with two detent receivers 156, 158 formed on a lengthwise side thereof, each disposed substantially adjacent one lengthwise end the first elongated slot 169. In the embodiment disclosed in FIG. 20, the resilience of the elongated tab 150 is provided by a spring equipped elongated backing plate 154 that operates in a plane substantially coplanar to the second elongated slot 170. In addition to providing resilience, the elongated backing plate 154 provides structural integrity that is required to ensure that the elongated tab 150 travels in a direction substantially collinear with the second elongated slot 170. The elongated backing plate 154 comprises a plate substantially similar to the elongated backing plate 16 depicted in FIG. 8 with the exception that a spring element is built into the plate.

An elongated opening 162 is formed on each lengthwise end of the plate 154 such that there are four spring members (two 164 and two 166) and concaved lengthwise side. In its uncompressed state, all four corners represented by the spring members 164, 166 come in contact with the two lengthwise sides of the second elongated slot 170. The elongated backing plate 154 further comprises a detent disposed substantially at midsection on the opposing lengthwise side to the concaved lengthwise side. Referring to FIG. 18, the detent 160 is received in the detent receiver 158, thereby revealing the first status label 142 on the front face of the panel 152.

However, when a force is directed in the direction 144, each spring member 164 is brought closer together with its neighboring spring member 166 as depicted in FIG. 19, resulting in reduced elongated backing plate 154 width and disengaged detent 160 which enable the elongated backing plate 154 to slide along the second elongated slot 170.

Figure 20:
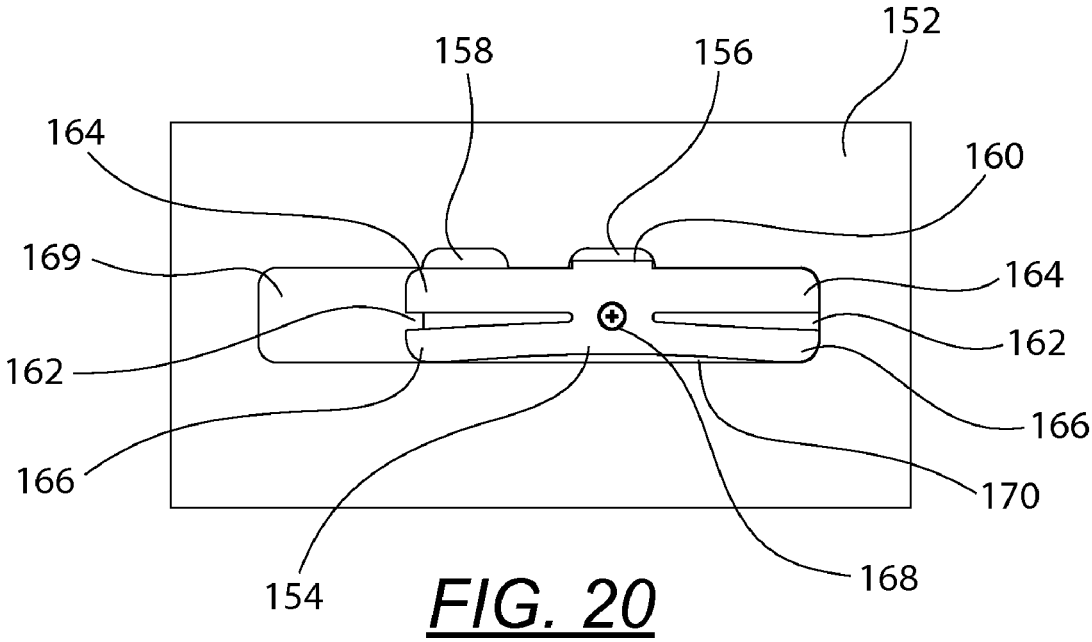
FIG. 20 is a bottom orthogonal view of the embodiment of FIG. 17 illustrating a detent mechanism of the task status indicator that is positioned to reveal a second status label.

FIG. 20 is a bottom orthogonal view of the embodiment of FIG. 17 illustrating a detent mechanism of the task status indicator that is positioned to reveal a second status label. In this position, the detent engages the detent receiver 156.

Figure 21:
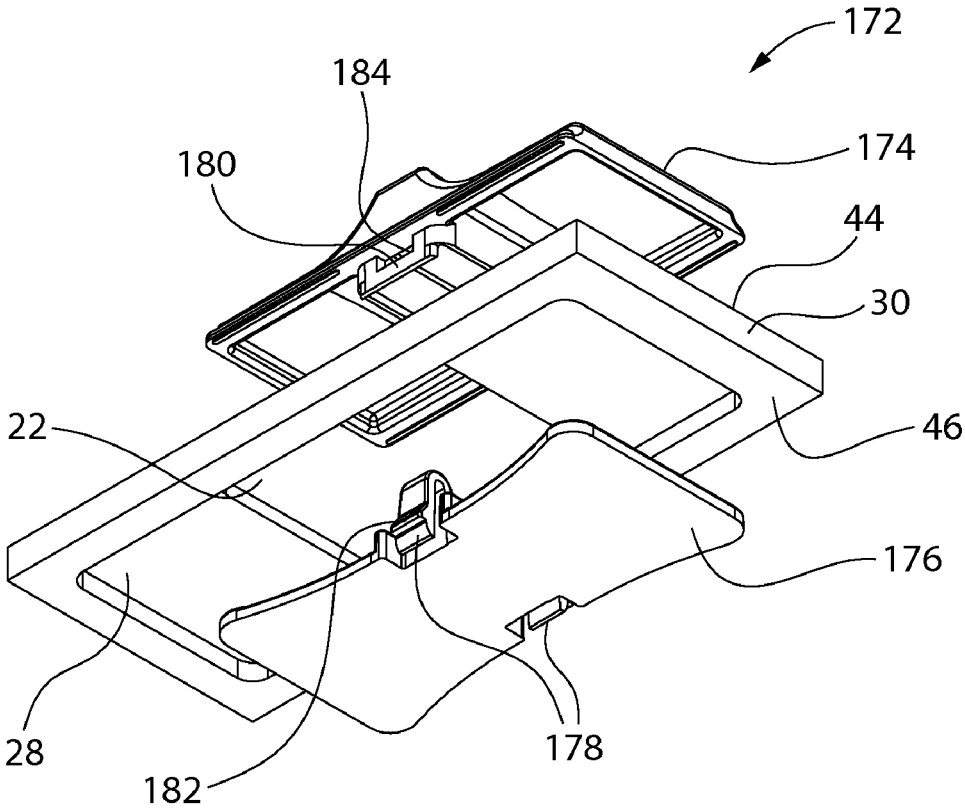
FIG. 21 is a bottom perspective exploded view of an alternate embodiment of the present invention illustrating a mechanism used to secure an elongated tab and an elongated plate.
Figure 22:
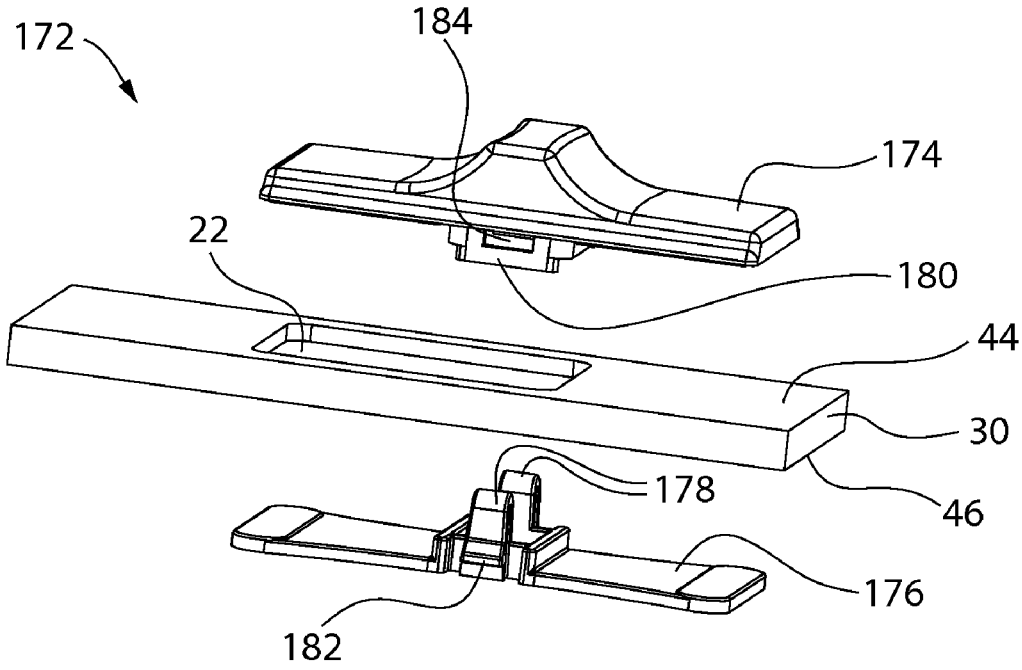
FIG. 22 is a top perspective exploded view of an alternate embodiment of the present invention illustrating a mechanism used to secure an elongated tab and an elongated plate.

FIGS. 21 and 22 are bottom and top perspective exploded views, respectively of an alternate embodiment of the present invention illustrating the components that make up a task status indicator 172. As depicted, a snap fit mechanism is used to removably affix an elongated tab 174 to an elongated backing plate 176. There is provided a pair of female snaps 180, each disposed on one lengthwise side on the bottom surface of the elongated tab 174. There is further provided a pair of mating male snaps 178, each disposed on one lengthwise side on the top surface of the elongated backing plate 176. During installation, the elongated tab 174 with the female snaps 180 facing the front face 44 of the panel 30 is brought into contacting engagement with the elongated backing plate 176 such that the shoulders 182 of the male snaps snap and lock in place with the loops 184 of the female snaps 180 to prevent relative movement of the elongated tab 174 and the elongated backing plate 176. When the elongated tab 174 and elongated backing plate 176 are due for replacement, the two parts 182, 184 are separable by simply compressing the shoulders 182 of the male snaps together and pulling the elongated backing plate 176 away from the elongated tab 174.

It will be appreciated by those skilled in the art that while the invention has been described above in connection with particular embodiments the invention is not necessarily so limited and that numerous other embodiments, uses, modifications and departures from the embodiments, and uses may be made without departing from the inventive concepts.

What is claimed herein is:

1. A medical task status checklist for aiding medical personnel in identifying unfinished tasks, comprising:

a panel having a front face and a rear face; and at least one two-status indicator disposed on a portion of said front face of said panel, wherein said two-status indicator is generally elongated with each of its two lengthwise ends having a status label, each two-status indicator comprises an opaque elongated tab configured to be slideable in the lengthwise direction of said two-status indicator, when said elongated tab is disposed at a lengthwise end of said two-status indicator, visually obscures the status label disposed at said lengthwise end, thereby revealing a status represented by the status label disposed at the opposing end of said indicator and said two-status indicator further comprises a detent means having a resilient trigger having one detent and operably received by at least one detent receiver disposed on said first elongated slot such that when said resilient trigger is depressed, said at least one detent is disengaged from said at least one detent receiver, permitting movement of said elongated tab and when said resilient trigger is released, said at least one detent is engaged in said at least one detent receiver to disallow movement of said elongated tab, thereby securing the position of said elongated tab to said panel to prevent accidental movement of said elongated tab at rest.

2. A medical task status checklist for aiding medical personnel in identifying unfinished tasks, comprising:

a panel having a front face and a rear face;

at least one two-status indicator, each having a height and a width and comprising:

a first elongated slot having a length and a width and formed in said front face of said panel and longitudinally aligned with a horizontal central axis of said two-status indicator;

a second elongated slot having a length and a width and formed in said rear face of said panel and centrally disposed along the length and the width of said first elongated slot, wherein said width of said first elongated slot is slightly smaller than said width of said second elongated slot and said length of said first elongated slot is substantially smaller than said length of said second elongated slot such that a ledge is formed around the periphery of said second elongated slot;

two status labels, each disposed adjacent each lengthwise end of said first elongated slot;

an elongated tab having a centrally disposed finger hold and positioned on said front face of said panel;

an elongated backing plate having two lengthwise ends, a length and a width and configured to slide within said second elongated slot, wherein said elongated backing plate is fixedly attached via a securing means to said elongated tab such that a sliding movement of said elongated backing plate is coordinated with a sliding movement of said elongated tab and said elongated tab substantially covers said first elongated slot, leaving only one of said two status labels visible at rest; and said width of said elongated backing plate is substantially the width of said second elongated slot and said length of said elongated backing plate is substantially the length of said elongated tab such that a tendency of said sliding movement of said elongated tab to deviate from an intended path as delineated by said second elongated slot is avoided and the movement of said elongated tab is confined to the lengthwise direction of said elongated tab.

3. The medical task status checklist of claim 2, wherein said elongated backing plate further comprises two lengthwise ends that are biased toward said ledge such that sufficient resistance is exerted thereto to prevent inadvertent sliding movement of said elongated tab.

4. The medical task status checklist of claim 2, wherein said two-status indicator further comprises a detent means having two detents, each detent disposed substantially at a lengthwise end of said elongated backing plate and comprising a protrusion that forms a curved surface which engages said one lengthwise end of said elongated backing plate with a corner of a lengthwise end of said first elongated slot when said two-status indicator is pushed to a travel limit such that accidental sliding movement of the two-status indicator is minimized.

5. The medical task status checklist of claim 4, wherein an initial force of at least 0.4 lbs is required to cause said elongated tab to move from said travel limit.

6. The medical task status checklist of claim 2, wherein said two-status indicator further comprises a detent means having a resilient trigger having one detent and operably received by at least one detent receiver disposed on said first elongated slot such that when said resilient trigger is depressed, said at least one detent is disengaged from said at least one detent receiver, permitting movement of said elongated tab and when said resilient trigger is released, said at least one detent is engaged in said at least one detent receiver to disallow movement of said elongated tab, thereby securing the position of said elongated tab to said panel to prevent accidental movement of said elongated tab at rest.

7. The medical task status checklist of claim 2, wherein each said two status labels have contrasting colors.

8. The medical task status checklist of claim 2, wherein said securing means comprises a screw.

9. The medical task status checklist of claim 2, wherein said securing means comprises a snap-fit.

10. The medical task status checklist of claim 2, wherein said two-status indicator is capable of withstanding cumulative repeated use of 20,000 actuations without experiencing performance degradation, said panel is capable of withstanding a front or side impact force of at least 30 lbs. without damage, said panel is capable of withstanding a front or side torsion force of at least 20 in-lbs. without damage.

11. The medical task status checklist of claim 2, wherein said rear face is flat and non-protruding such that said panel is capable of being flush mounted to a support system.

12. A method for constructing a medical task status checklist comprising a panel having a front face, a rear face and at least one medical task status indicator, wherein said at least one medical task status indicator comprises one indicium substantially horizontally aligned with an indicator, comprising steps of preparing an electronic template having cells defined by two adjacent columns and at least a row, wherein each cell on the left column of said two adjacent columns is populated with an indicium while each cell on the right column is populated with an indicator;

arranging said at least one medical task status indicator by simultaneously moving each populated cell on the left column of said two adjacent columns with its associated populated cell on the right column of said two adjacent columns;

communicating said electronic template to a CNC machine such that at least one indicator is formed on one of said two adiacent columns and a row, a label is printed on each lengthwise end of said indicator and an indicium is printed on said row on the opposing column, wherein said indicator is constructed by the steps of forming a first elongated slot having a length and a width in said front face of said panel and longitudinally aligned with said indicator's horizontal central axis;

forming a second elongated slot having a length and a width in said rear face of said panel and that is centrally disposed along the length and width of said first elongated slot, wherein said width of said first elongated slot is slightly smaller than said width of said second elongated slot and said length of said first elongated slot is substantially smaller than said length of said second elongated slot such that a ledge is formed around the periphery of said second elongated slot; and providing an elongated backing plate configured to slide within said second elongated slot, wherein said elongated backing plate is fixedly attached via a securing means to an elongated tab such that a movement of said elongated backing plate is coordinated with a movement of said elongated tab and said elongated tab substantially covers the first elongated slot and one of said two status labels, leaving the other of said two status labels visible at rest and said width of said elongated backing plate is substantially a width of said second elongated slot and said length of said elongated backing plate is substantially a length of said elongated tab such that the movement of said elongated tab is confined to the lengthwise direction of said elongated tab.

13. A method for constructing a medical task status checklist comprising a panel having a front face, a rear face and at least one medical task status indicator, wherein said at least one medical task status indicator comprises one indicium substantially horizontally aligned with an indicator, comprising steps of preparing an electronic template having cells defined by two adjacent columns and at least a row, wherein each cell on the left column of said two adjacent columns is populated with an indicium while each cell on the right column is populated with an indicator;

arranging said at least one medical task status indicator by simultaneously moving each populated cell on the left column of said two adjacent columns with its associated populated cell on the right column of said two adjacent columns;

communicating said electronic template to a CNC machine such that at least one indicator is formed on one of said two adjacent columns and a row, a label is printed on each lengthwise end of said indicator and an indicium is printed on said row on the opposing column, wherein said indicator is constructed by the steps of forming a first elongated slot having a length and a width in said front face of said panel and longitudinally aligned with said indicator's horizontal central axis;

forming a second elongated slot having a length and a width in said rear face of said panel and that is centrally disposed along the length and width of said first elongated slot, wherein said width of said first elongated slot is slightly smaller than said width of said second elongated slot and said length of said first elongated slot is substantially smaller than said length of said second elongated slot such that a ledge is formed around the periphery of said second elongated slot; and providing an elongated backing plate having two lengthwise ends biased towards said ledge, a length and a width and configured to slide within said second elongated slot, wherein said elongated backing plate is fixedly attached via a securing means to an elongated tab such that a movement of said elongated backing plate is coordinated with a movement of said elongated tab and said elongated tab substantially covers the first elongated slot and one of said two status labels, leaving the other of said two status labels visible at rest and said width of said elongated backing plate is substantially a width of said second elongated slot and said length of said elongated backing plate is substantially a length of said elongated tab such that the movement of said elongated tab is confined to the lengthwise direction of said elongated tab.

* * * * *